United States Patent [19]

Woolley

[11] 4,160,301

[45] Jul. 10, 1979

[54] COMBINED HOLDER AND SOLE ACCESSORY

[76] Inventor: George C. Woolley, 55 Lakeshore Rd., Pointe Claire, Province of Quebec, Canada

[21] Appl. No.: 848,755

[22] Filed: Nov. 4, 1977

[51] Int. Cl.[2] ..... A43D 5/00; A43B 5/00

[52] U.S. Cl. ..... 12/120.5; 36/132

[58] Field of Search ..... 36/117, 132, 137; 12/120.5

[56] References Cited

U.S. PATENT DOCUMENTS

| | | | |
|---|---|---|---|
| 3,412,866 | 11/1968 | Binding | 12/120.5 |
| 3,590,410 | 7/1971 | Shields | 12/120.5 |
| 3,737,933 | 6/1973 | Wunder | 12/120.5 |

FOREIGN PATENT DOCUMENTS

| | | | |
|---|---|---|---|
| 573729 | 3/1976 | Switzerland | 36/132 |

*Primary Examiner*—Patrick D. Lawson

*Attorney, Agent, or Firm*—Swabey, Mitchell, Houle, Marcoux & Sher

[57] ABSTRACT

There is provided a combined holder and sole accessory for ski boots or ice skates, wherein the sole accessory includes a resiliently selectively extensible two-piece member including a front piece and a rear piece, retaining means on the front piece adapted to engage the toe of the sole of a ski boot, and a heel engaging means on the rear piece adapted to engage the heel of a sole of a ski boot and the member having a flat platform surface coinciding with the flat surface of a ski boot sole and the member having a convexly curved ground engaging surface extending from the toe to the heel, whereby when the ski boot is worn without skis but including the sole accessory, the curve of the ground engaging surface will simulate normal ambulatory movement.

3 Claims, 6 Drawing Figures

COMBINED HOLDER AND SOLE ACCESSORY

BACKGROUND OF THE INVENTION

1. Field of the Invention

The present invention relates to boots, and more particularly, to a combined holder and sole accessory for ski boots, ice skates or the like.

2. Description of the Prior Art

Alpine ski boots are for the most part made of a rigid molded plastics material with little or no flexibility. The sole of the ski boot, which is molded integrally with the upper, is molded flat such that it will engage a flat top surface of a ski for proper engagement with the binding. The ski boots are molded primarily for ultimate function when engaged in the ski binding on a ski. Since the skier should always have his knees slightly bent forward, the axis of one's foot extending upwardly from the heel is at a slight forward angle to the plane of the sole of the boot. However this is not the normal stance for most bipeds, especially human beings, and is not a good walking position when one attempts to walk with the ski boots. The result is a bent-kneed, flat-footed walk which is, to say the least, uncomfortable.

A sole accessory is described in Italian Pat. No. 1,003,982. In that patent, a sole accessory having a convex ground engaging surface is described.

SUMMARY OF THE INVENTION

It is an aim of the present invention to provide a sole accessory which is an improvement over the accessory described in Italian Pat. No. 1,003,982.

It is a further aim of the present invention to provide a holder adapted to hold and provide a carrier for a pair of ski boots to which sole accessories of the type described have been attached.

An apparatus in accordance with the present invention includes a member having a flat boot sole receiving platform, the member having at least a toe section and a heel section, and each section having means for engaging the respective toe and heel of the sole, means for resiliently urging the toe section to the heel section, and a ground engaging surface having a convexly curved portion extending from the toe to the heel and the curve being selected such that it simulates the normal rocking motion from heel to toe of a person's foot in a normal walking pace.

Another feature of the present invention includes a holder having a handle member and a stem member extending from the handle, the stem member having a sole accessory gripping means adapted to engage the sole accessory mounted to a boot with the ground engaging surfaces of the sole accessories facing each other.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 1:
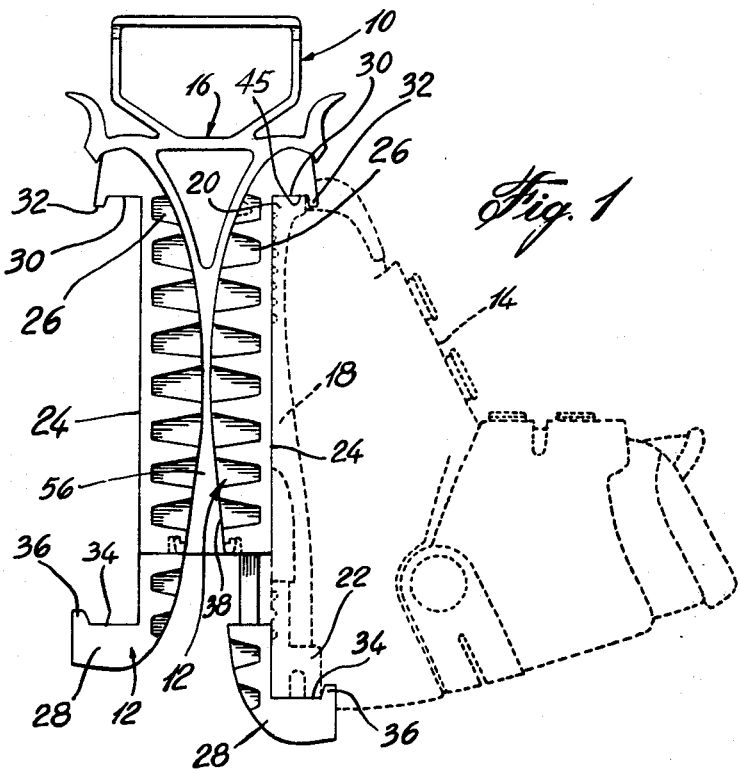
FIG. 1 is a side elevation of a holder with a pair of sole accessories engaged thereon and a ski boot shown in dotted lines.

Referring now to the Figures, and particularly to FIG. 1, the combined holder and sole accessories 10 are illustrated with a typical ski boot 14 shown in one of the sole accessories 12. A holder and sole accessory 10 includes a holder 16 to which is mounted a pair of sole accessories 12. The boot has a boot sole 18 with the sole having a toe 20 and a heel 22.

Figure 3:
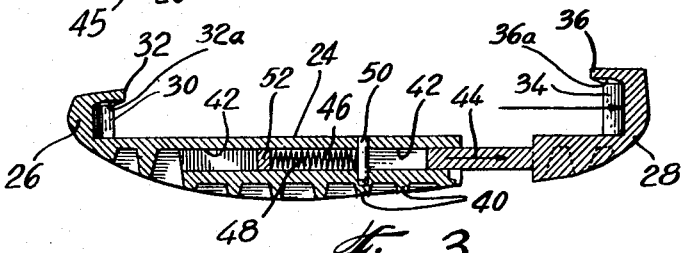
FIG. 3 is a vertical, longitudinal, cross-sectional view of the sole accessory.
Figure 4:
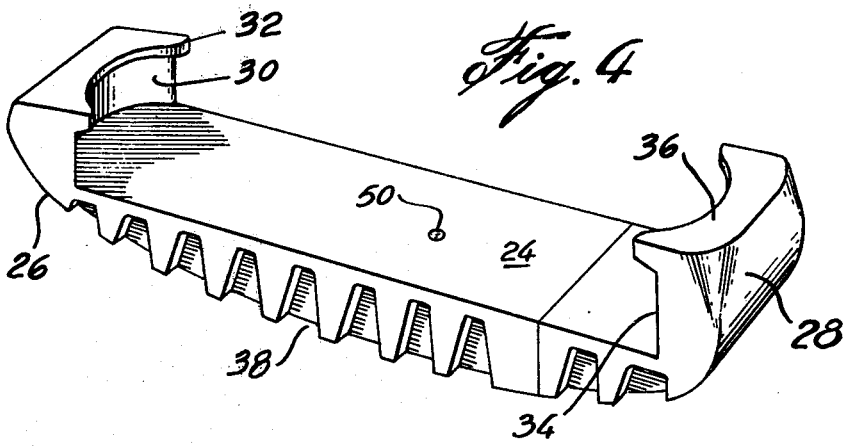
FIG. 4 is a perspective view seen from the top of the sole accessory.
Figure 5:
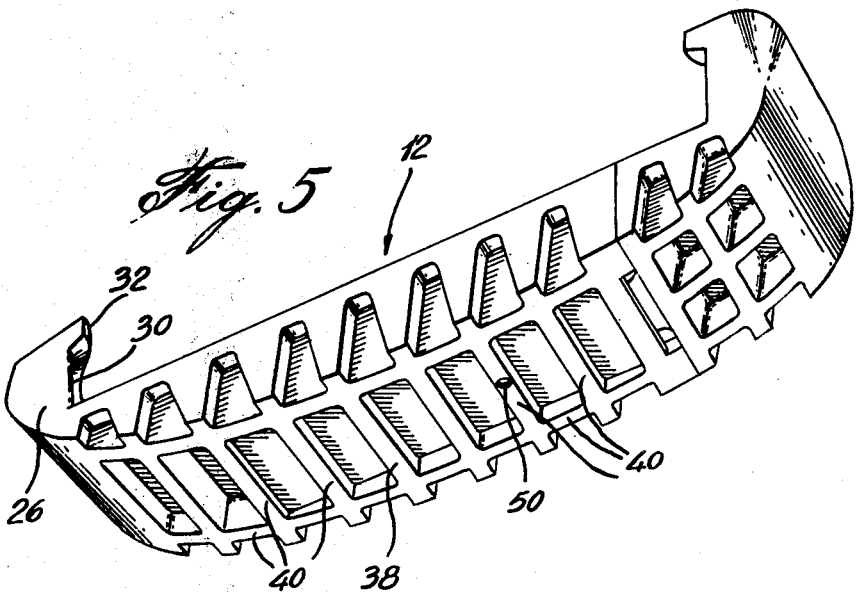
FIG. 5 is a perspective view taken from the bottom of the sole accessory.

Referring now to FIGS. 3 through 5, the sole accessory 12 is shown having a flat platform surface 24 which is adapted to engage the flat bottom surface of the sole 18 of a boot 14. The sole accessory 12 includes a front toe section 26 and a rear heel portion 28. The toe accessory 12 is resiliently extensible as will be described later. The front toe section 26 includes a retainer 30 having a retaining flange 32 adapted to engage the toe 20 of the boot sole 18. Similarly, the heel section 28 is provided with a retainer 34 and retaining flange 36 adapted to engage the heel 22 of the sole 18 of the boot 14. It is understood that the dimensions of the toe and heel of ski boot soles are of standard dimensions. For instance, the height of the toe 20 is normally 19 millimeters while the height of the heel 22 is 30 millimeters. In any case, the retaining flanges 32 and 36 are provided with inwardly sloping surfaces **32*a* and 36*a* respectively in order to engage the toe and heel 20 and 22 of the sole 18** in a wedge manner compensating for variants from the normal height dimensions of the sole, toe and heel areas.

Figure 2:
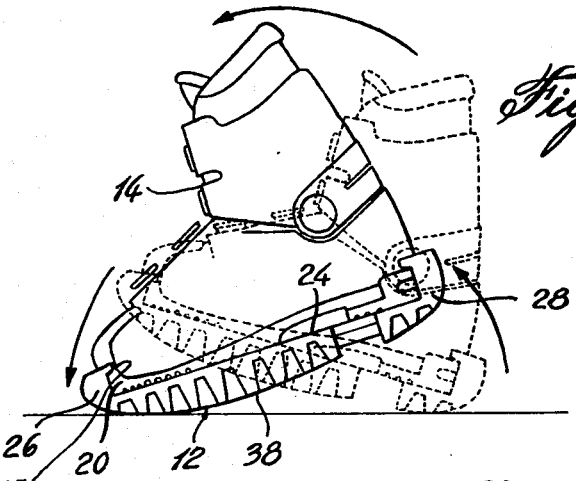
FIG. 2 shows a typical ski boot with the sole accessory mounted thereon.

The sole accessory 12 is provided with a ground engaging surface 38 which is curved convexly from the toe to the heel. It is understood that in a normal walking step, one's foot rocks from the heel to the ball of the foot. However, with the rigid and relatively heavy ski boot, this walking motion is not easily obtained, and rather than the normal rocking from heel to ball of the foot motion, a person wearing this type of ski boot normally ends up shuffling in a planar manner. In order to simulate the rocking motion of one's foot while wearing ski boots, the sole accessory 12 has been provided with the somewhat convex, curved, ground engaging surface 38 which is calculated to resemble as closely as possible the normal rocking motion of the foot, as shown in FIG. 2. The ground engaging surface 38 is provided with cross ribs 40 in order to provide a suitable grip for the sole accessory 12.

The sole accessory 12 is made extensible by providing the heel section 28 with a forwardly extending plunger 44 of normally square cross-section, adapted to slide snugly in a female bore provided in the toe section 26. The plunger 44 includes a slot 46 in which a compression spring 48 is located, abutting against the abutment 52 at the end of the slot in the plunger 44. The other end of the spring engages the pin 50 which traverses the slot 46. Accordingly, the sole accessory 12 can be selectively opened to any size of ski boot. A recess 45 is provided in the end surface of the toe section 26 for receiving the hook flange 62 or 64 of the holder 16, as will be described later.

The sole accessory may be molded from any suitable material, preferably from a closed, cellular, polyethylene or polypropylene copolymer plastics material.

In operation, the sole accessory 12 is easily mounted to a ski boot by pulling the toe section 26 and heel section 28 apart, allowing the spring 48 to retract the sections such that the toe retainer 30 and heel retainer 36 engages the respective toe 20 and heel 22 of the sole 18 of the ski boot 14. A person wearing the sole accessories can then more easily walk about while wearing the ski boots 14 without skis. Once it is necessary to mount the skis, the sole accessories 12 are merely removed from the boot sole 18 and stored. When the ski boots are removed and it is necessary to carry the ski boots, the sole accessories 12 are left engaged on the soles 18 of the respective boots, and a pair of boots including the sole accessories 12 are engaged on a holder 16.

Figure 6:
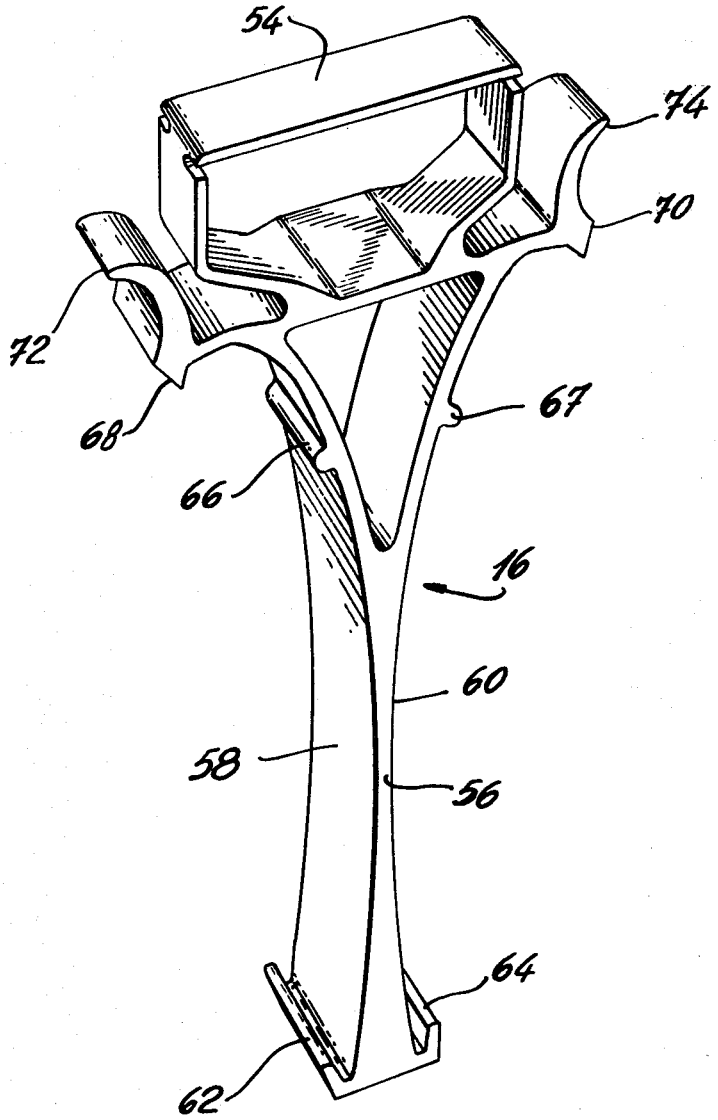
FIG. 6 is a perspective view of the holder.

The holder 16 includes, as shown in FIG. 6, a handle 54 and a stem 56. The stem 56 has opposed, concavely curved surfaces 58 and 60 adapted to engage the ground supporting surfaces 38 of the sole accessories 12. A hook-type flange 62 and a similar flange 64 engage recesses provided in the ground engaging surface 38 of each sole accessory 12, as shown in FIG. 1, while the toe section 26 of each sole accessory 12 is snapped under the locking noses 68 and 70 respectively. Locating ribs 66 and 67 are provided on the mating surfaces 58 and 60 so as to engage between ribs 40 so as to prevent the sole accessories 12 and, therefore, the boots from sliding out of the holder 16 sideways.

When it is desired to detach the sole accessories 12 from the holder 16, levers 72 and 74 are depressed inwardly, thereby disengaging the locking noses 68 and 70 from the toe section 26 of the respective sole accessories 12. Of course, the holder 16 should be made of a resilient pliable plastics material so as to provide the necessary hinging movement of the portions adjacent the locking noses 68 and 70.

I claim:

1. A holder adapted to engage a pair of sole accessories for carrying a pair of boots, wherein the sole accessories include toe sections and convexly curved ground engaging surfaces, the holder including a handle, a stem extending from the handle, the stem including a pair of opposed curved surfaces adapted to mate with the ground engaging surfaces of a pair of opposed sole accessories, and retaining means on the holder for detachably retaining the sole accessories to the holder.

2. A holder as defined in claim 1, wherein the retaining means includes a pair of hook-shaped flanges at the end of the stem opposite the handle, the hook-shaped flanges adapted to engage in recesses provided in the sole accessories, and locking noses adjacent the handle being resiliently hinged to engage the end of the toe section of the sole accessory, and depressible lever means for releasing the locking noses from the sole accessory, whereby the sole accessory and holder can carry a pair of ski boots.

3. A holder and sole accessory combination for carrying boots, such as ski boots or the like, including the holder and a pair of sole accessories for the boots, each sole accessory having a sole-receiving platform coinciding with the bottom of the boot, a toe-retaining means and a heel-retaining means, the toe-retaining means including a seat for engaging the front portion of the bottom of a boot to be engaged, and the heel-engaging means including an engagement seat adapted to engage the rear portion of the bottom of the boot, resilient means for resiliently urging the toe-retaining means and the heel-retaining means onto the bottom of the boot, and a ground engaging surface having a convexly curved portion extending from toe to heel, and the curve being selected such that it simulates the normal rocking motion from heel to toe of a person's foot in a normal ambulatory movement, the holder including a handle, a stem extending from the handle, the stem including a pair of opposed curved surfaces adapted to mate with the ground engaging surfaces of the pair of opposed sole accessories, and retaining means on the holder for detachably retaining the sole accessories of the holder.

* * * * *